US009761106B1

(12) United States Patent
Campbell et al.

(10) Patent No.: US 9,761,106 B1
(45) Date of Patent: Sep. 12, 2017

(54) ANTI-INTRUSION DEVICE FOR SIMULATING GUN COCKING

(71) Applicant: John C Campbell, Longview, TX (US)

(72) Inventors: John C Campbell, Longview, TX (US); Christian W Brown, Loveland, CO (US)

(73) Assignee: John C. Campbell, Longview, TX (US)

( * ) Notice: Subject to any disclaimer, the term of this patent is extended or adjusted under 35 U.S.C. 154(b) by 0 days.

(21) Appl. No.: 15/279,420

(22) Filed: Sep. 28, 2016

(51) Int. Cl.
*F41A 33/06* (2006.01)
*G08B 15/00* (2006.01)
*G08B 3/10* (2006.01)

(52) U.S. Cl.
CPC ..... *G08B 15/002* (2013.01); *G08B 3/10* (2013.01)

(58) Field of Classification Search
CPC ..... A64H 5/04; F41A 33/04; F41A 33/06
USPC ..... 340/541, 384.3, 384.73, 692; 446/405, 446/406, 407
See application file for complete search history.

(56) References Cited

U.S. PATENT DOCUMENTS

| | | | |
|---|---|---|---|
| 1,995,019 | A | 3/1935 | Whetherhult |
| 2,187,194 | A | 1/1940 | Chapman |
| 2,450,447 | A | 10/1948 | Samuel |
| 3,895,599 | A | 7/1975 | Berkowitz |
| 3,929,259 | A | 12/1975 | Fegley et al. |
| 3,930,597 | A | 1/1976 | Fegley |
| 4,024,830 | A | 5/1977 | Fegley et al. |
| 4,024,986 | A | 5/1977 | Fegley et al. |
| 4,187,797 | A | 2/1980 | Hoinski |
| 4,418,638 | A | 12/1983 | Lesly et al. |
| 4,762,082 | A | 8/1988 | Suchevits |
| 5,326,303 | A | 7/1994 | D'Andrade |
| 5,457,442 | A | 10/1995 | Lucero |
| 6,130,610 | A | 10/2000 | Schilsky et al. |
| 6,198,404 | B1 | 3/2001 | Campagnuolo et al. |
| 6,285,287 | B1 | 9/2001 | Jones et al. |

(Continued)

FOREIGN PATENT DOCUMENTS

| | | |
|---|---|---|
| BE | 1014691 A7 | 3/2004 |
| FR | 2293017 B1 | 2/1982 |

(Continued)

OTHER PUBLICATIONS

Inexpensive Mini-Sentry Trip Wire Alarm—Made in the USA Series; Ammoland, Jan. 28, 2013; 3 pages.

(Continued)

*Primary Examiner* — Kevin Kim
(74) *Attorney, Agent, or Firm* — Mark W Handley

(57) ABSTRACT

An anti-intrusion device simulates the sound of a round being chambered in a pump shotgun using metal parts which strike one another. A striker carriage is movably disposed in a sound box for moving between first and second positions to engage metal striker plates and metal striker tabs against sound plates to simulate the chambering sound. A mangle drive assembly is mounted atop the sound box for moving the striker carriage between a forward position and a rearward position, powered by a stepper motor which is actuated to rotate a controlled axial displacement when a trigger mechanism is tripped. Preferably, the trigger mechanism is provided by a light mean sensor in which the light beam is broker by an intruder passing a selected entry point.

20 Claims, 6 Drawing Sheets

(56) References Cited

U.S. PATENT DOCUMENTS

| | | | | |
|---|---|---|---|---|
| 6,646,563 | B1 | 11/2003 | Buckley et al. | |
| 6,695,676 | B2 * | 2/2004 | Blake | A63H 5/04 446/401 |
| 7,268,689 | B2 | 9/2007 | Sulaver | |
| 7,388,485 | B1 | 6/2008 | Shen | |
| 8,471,688 | B2 | 6/2013 | Preston et al. | |
| 9,464,860 | B2 * | 10/2016 | Wilson | F41A 33/04 |
| 2003/0116100 | A1 | 6/2003 | Cullen | |
| 2003/0181128 | A1 * | 9/2003 | Blake | A63H 5/04 446/475 |
| 2008/0111687 | A1 | 5/2008 | Husmann | |

FOREIGN PATENT DOCUMENTS

| | | | |
|---|---|---|---|
| GB | 191301764 | | 11/1913 |
| GB | 315359 | | 6/1930 |
| GB | 2254464 | A | 10/1992 |
| GB | 2273379 | A | 6/1994 |
| WO | WO9535558 | A1 | 12/1995 |

OTHER PUBLICATIONS

Shotgun Alarm Signal; DefenseDevices.com; Jul. 16, 2014; 1 page.
Alarm Trip Mine 12g Shotgun; AirsoftWorld.com; Jul. 16, 2014; 1 page.

* cited by examiner

ANTI-INTRUSION DEVICE FOR SIMULATING GUN COCKING

TECHNICAL FIELD OF THE INVENTION

The present invention relates in general to home security devices, and in particular to an entry activated alarm to ward off uninvited intruders.

BACKGROUND OF THE INVENTION

Prior art alarm devices have been provided to sound alarms when intruders enter into buildings. Conventional type alarms will sound a siren or activate a horn to create a loud noise to alert those proximate to the building that an unwanted entry has occurred and to scare away intruders. Other security devices have included spring guns, which are aimed at an entry point and fired when an intruder is located proximate to the entry point and trips a trigger. Spring guns are currently outlawed in the United States due to serious injury caused by their use. Other types of security devices have included recorded sounds such as gunshots, cocking of weapons, and replicating the sound of a shotgun shell begin chambered. However, the recorded devices are not effective since they do not provide realistic sound.

SUMMARY OF THE INVENTION

An anti-intrusion device simulates the sound of a round being chambered in a pump shotgun using metal parts which are engaged together to simulate such sounds. A sound box is provided in which is moveably disposed a striker carriage. The striker carriage is moved within the sound box to engage metal striker plates and striker tabs against sound plates to simulate the chambering sound. Slide rails and guide rails engage the striker carriage during movement. A mangle drive assembly is mounted atop the sound box for moving the striker carriage between a forward position and a rearward position, powered by an electric drive motor. The drive motor, preferably a stepper motor, is actuated to rotate a controlled axial displacement to move the striker carriage between the forward and rearward positions when a trigger mechanism is tripped. Preferably, the trigger mechanism is provided by a light bean sensor in which the beam is broken by an intruder in passing a selected entry point.

DESCRIPTION OF THE DRAWINGS

For a more complete understanding of the present invention and the advantages thereof, reference is now made to the following description taken in conjunction with the accompanying Drawings in which

FIG. 1 is a perspective view of an anti-intrusion device for simulating gun cocking according to the present invention;

FIG. 2 is a perspective view of a light actuated switch providing a trigger for the anti-intrusion device;

FIG. 3 is a perspective view looking downward on a sound box of the anti-intrusion device of FIG. 1;

FIG. 4 is a perspective view of a striker carriage to which striker plates and striker tabs are mounted for striking and sound plates mounted to a frame enclosure of the sound box of FIG. 3;

FIGS. 5 and 6 are exploded views of the striker carriage from the sound box in FIG. 3;

FIG. 7 is a perspective view of a piston body slidably mounted within the striker carriage;

FIGS. 8 and 9 are perspective sectional views of a piston body slidably mounted within the striker carriage;

FIG. 10 is an exploded view of the mangle drive assembly and the striker carriage;

FIG. 11 is a top view of a mangle gear drive train used in the mangle drive assembly of FIGS. 1 and 10;

FIG. 12 is a perspective view and FIG. 13 is a top view of a gear rack for the mangle gear drivetrain of FIGS. 1, 10 and 11; and FIG. 14 is a perspective view of a cover for the anti-intrusion device shown in FIG. 1.

DETAILED DESCRIPTION OF THE INVENTION

Figure 1:
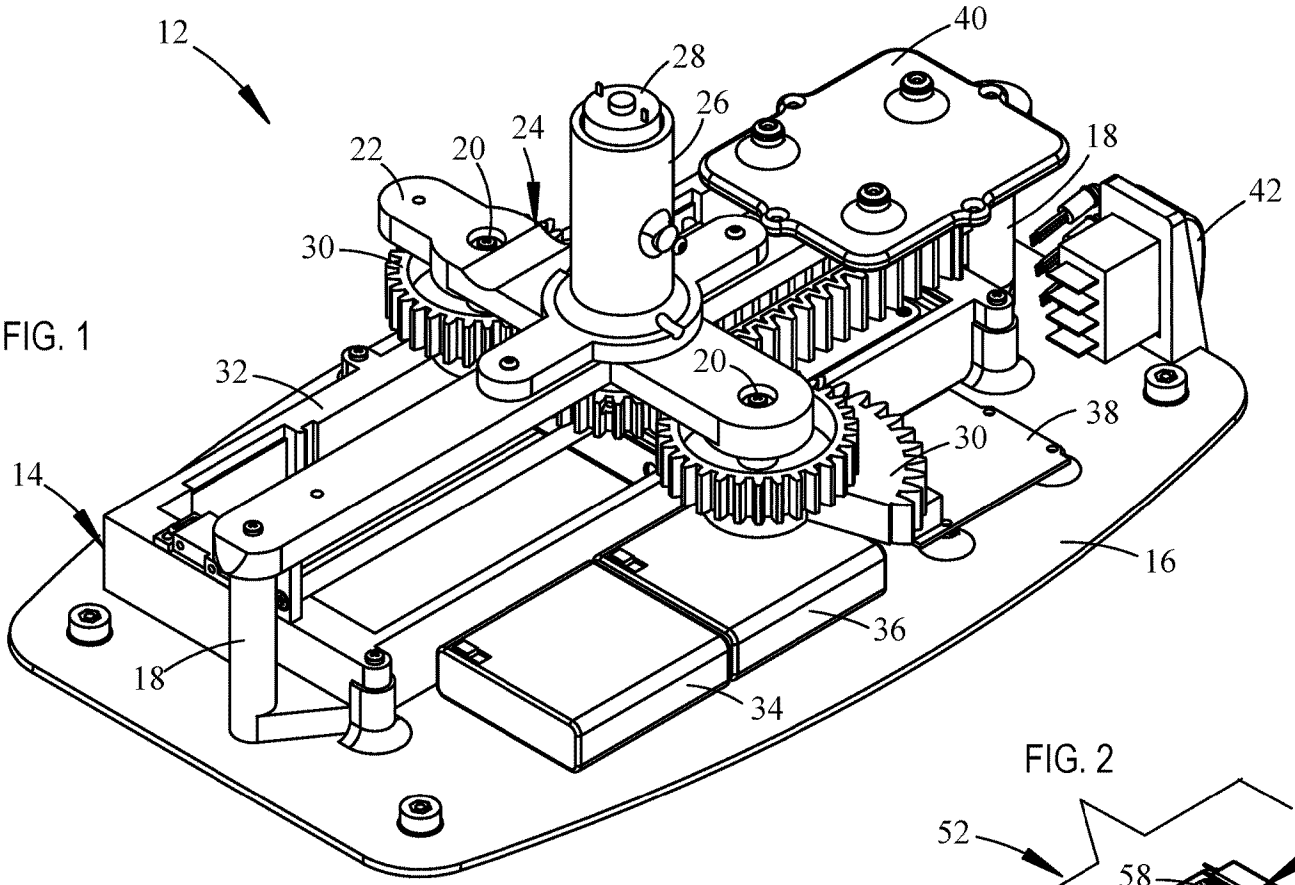
FIGS. 1 through 14 show various aspects for anti-intrusion device for simulating gun cocking devices made according to the present invention, as set forth below.

FIG. 1 is a perspective view of an anti-intrusion device 12 having a chassis 14. The chassis includes a base plate 16 and two support posts 18 and two spindles 20 which are mounted to vertically extend upward from the base plate 16. A bracket 22 provides a yoke which is mounted atop the support posts 18 and the spindles 20. A mangle drive assembly 24 is secured to the bracket 22. The mangle drive 24 includes a motor mount 26 and an electric drive motor 28 mounted atop the bracket 22, and a mangle gear drive train 30 mounted beneath the bracket 22. A sound box 32 is located beneath the mangle gear drive train 30. Two power supplies 34 and 36 are mounted to the base plate 16, to one side of the sound box 32. The two power supplies 34 and 36 are preferably batteries, but in some embodiments a combination of batteries and transformers may be used for adapting the device 12 for connecting to conventional building electric power. A circuit board 38 is mounted adjacent the sound box 32 and the power supply 36, mounted directly to the base plate 16. The circuit board 38 provides an electronic control unit for controlling operation of the anti-intrusion device 12. A mount 40 is provided for mounting a second circuit board directly to the bracket 22, rearward of the motor mount 26. A control switch 42 is mounted at one end of the base plate 16.

Figure 2:
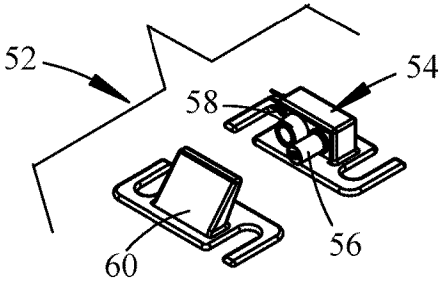

FIG. 2 is a perspective view of a motion sensor 52 used as an actuation device for triggering operation of the anti-intrusion device 12. Sensor unit 54 has a light output 56 and a light detector 58. A reflector 60 is provided for spacing apart from the sensor unit 54 and reflecting light from the light output 56 back to the light detector 58. When an intruder passes between the sensor unit 54 and the reflector 60, the light output 56 to the reflector 60 and back to the light detector 58 is broken, indicating that an intruder has passed through an entry point and actuating or triggering the anti-intrusion device 12.

Figure 3:
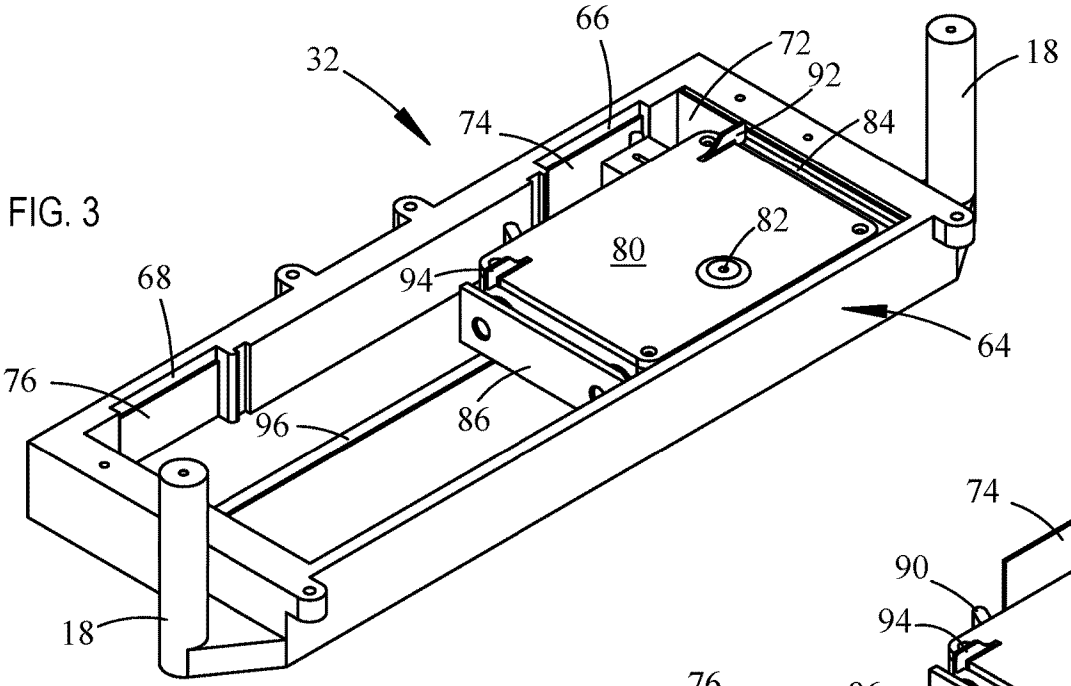
Figure 4:
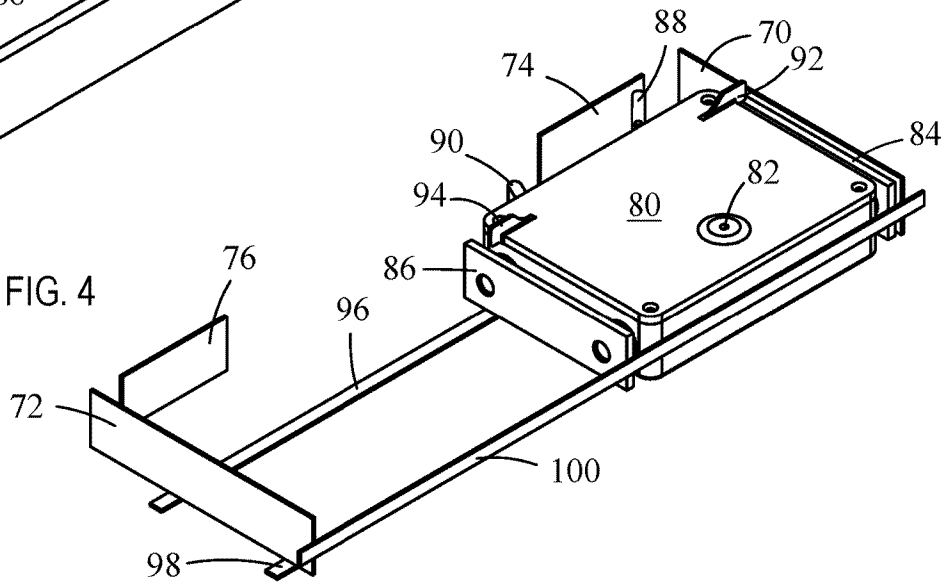

FIG. 3 is a perspective view of the sound box 32, and FIG. 4 is a perspective view of a striker carriage 80 which is moveably disposed within the sound box 32. FIG. 4 also shows sound plates 70-76, striker plates 84 and 86, and striker tabs 88 and 90. The striker plates 84, 86 and striker tabes 88, 90 are mounted to the striker carriage 80, which is moved to strike the plates 84, 86 against respective ones of the sound plates 70 and 72, and to strike the tabs 88, 90 against respective ones of the sound plates 74 and 76 in a preselected sequence for replicating the sound of a shotgun shell being chambered in a pump shotgun. The sound box 32 has a frame enclosure 64 with a recess 66 and recess 68. The recess 68 is spaced apart from the recess 66. The rearward sound plate 70 is mounted to a rearward end of the frame enclosure 64 of the sound box 32, and a forward sound plate 72 is mounted to the forward end of the frame enclosure 64. A first sound plate 74 is located in the first recess 66, and a second sound plate 76 is located in the second recess 68.

The striker carriage 80 is moveably mounted within the frame enclosure 64 for sliding on slide rails 96 and 98 and against a guide rail 100. A mounting port 82, preferably disposed with a threaded connection, is provided for securing the striker carriage 80 to a rack 190 of the mangle drive assembly 24 for moving therewith. The rearward striker plate 84 is mounted to the rearward end of the striker carriage 80 for striking the rearward sound plate 70 when the carriage 80 is moved into the rearward position. A forward striker plate 86 is mounted to the forward end of the carriage 80 striking the forward sound plate 72 when the carriage 80 is moved to the forward position. The first striker tab 88 is moveably extended from a first side of the carriage 80 for striking the first sound plate 74 when the striker carriage 80 is moved to a rearward position. The second striker tab 90 moveably extends to strike the second sound plate 76 when the striker carriage 80 is moved to the forward position. Rearward spacer 92 and a forward spacer 94 are provided as stops which engage the frame enclosure 64 of the sound box 32 when the striker carriage 80 is moved between the forward and rearward positions.

Figure 6:
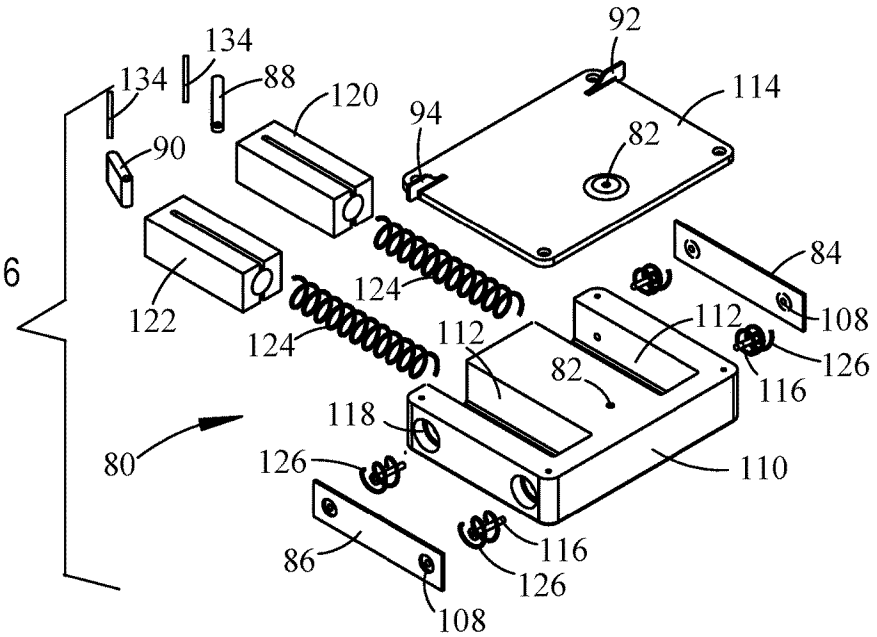
Figure 5:
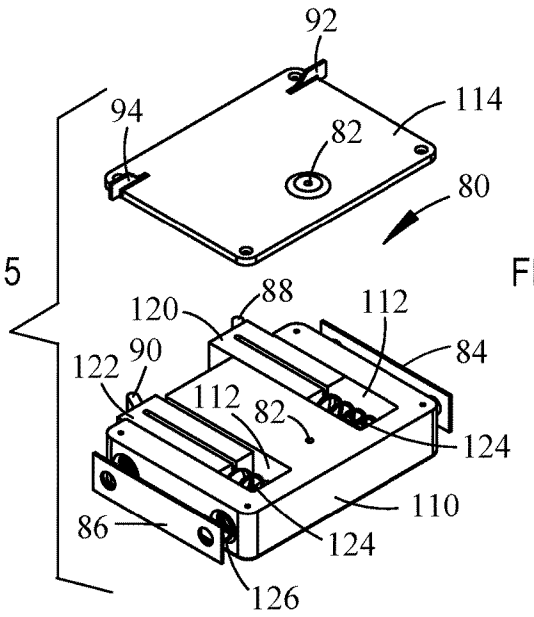

FIGS. 5 and 6 are exploded, perspective views of the striker carriage 80, showing the internal components thereof. The striker carriage 80 has a main body 110 and a cover plate 114 which is secured to the main body 110 by threaded fasteners (not shown). Two slots 112 are provided by grooves which extend from the side of the striker carriage 80 which is disposed adjacent to the first sound plate 74 and the second sound plate 76 when disposed within the frame enclosure 64 of the sound box 32. Slots 112 extend perpendicular, or transverse to the direction of travel of the striker carriage 80 within the sound box 32. Two slide pistons 120 and 122 are slidably disposed within respective ones of the slots 112. Bias springs 124 are disposed within respective ones of the slide pistons 120 and 122 for engaging the inward end of the slots 112 for biasing or pressing the slide pistons 120 and 122 into outward positions respective to the slots 112. The springs 126 are disposed between the main body 110 of the striker carriage 80 and respective ones of forward striker plate 86 and the rearward striker plate 84, with two springs disposed adjacent each of the striker plates 84, 86. Mounting bolts 116 are provided for extending through recessed apertures 108 of respective ones of the rearward striker plate 84 and the forward striker plate 86, and disposed within the center of respective ones of the springs 126. Preferably threaded holes 118 are recessed in the main body 110 for receiving ends of the bolts 116 and securing the rearward striker plate 84 and the forward striker plate 86 to the main body 110, spaced apart from the main body 110 by the bias springs 126. The heads of the bolts 116 are preferably located within the recessed holes 108 in the striker plates 84 and 86, so that only the outward end of the plates 84 and 86 will strike the sound plate 70 and 72 mounted to the frame enclosure 64 of the sound box 32, and not the heads of the bolts 116. The outward portions of the recesses holes 108 and 118 facing respective ones of the bias springs 126 have larger diameters than the portions for engaging the bolts 116, such that opposed ends of the springs 126 are retained therein.

Figure 9:
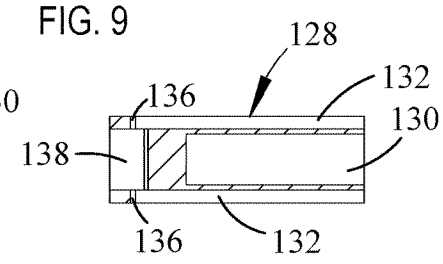
Figure 8:
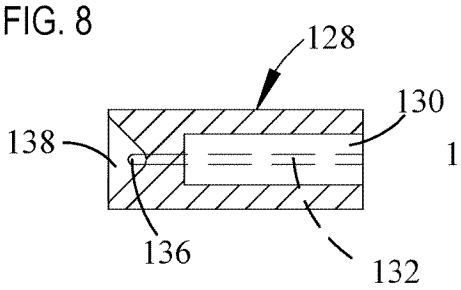
Figure 7:
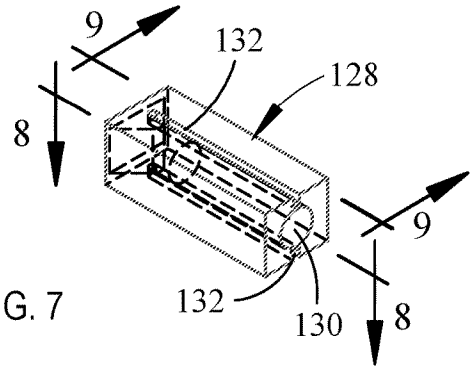

FIG. 7 is a perspective view and FIGS. 8 and 9 are sectional views of body 128 which is used for the slide pistons 120 and 122. Rearward end of the body 128 has a blind hole 130 for receiving respective ones of the springs 124. Slots 132 extend along opposite sides of the body 128, centrally disposed and aligned in parallel to the hole 130. A pin 134 is provided for fitting within a pin aperture 136 for pivotally securing the striker tabs 88 and 90 within respective ones of the body 128, utilized for respective ones of the pistons 120 and 122. Triangular shaped end recess 138 is provided for receiving respective ones of the striker tabs 88 and 90. During use, the bias springs 124 will urge the slide pistons 120 and 122 into outward positions, such that when the slide pistons 120 and 122 pass by a respective one of the recess 66 and 68, the slide pistons 120 and 122 will extend outward and cause respective ones of the striker tabs 88 and 90 to strike respective ones of the sound plates 74 and 76.

Figure 10:
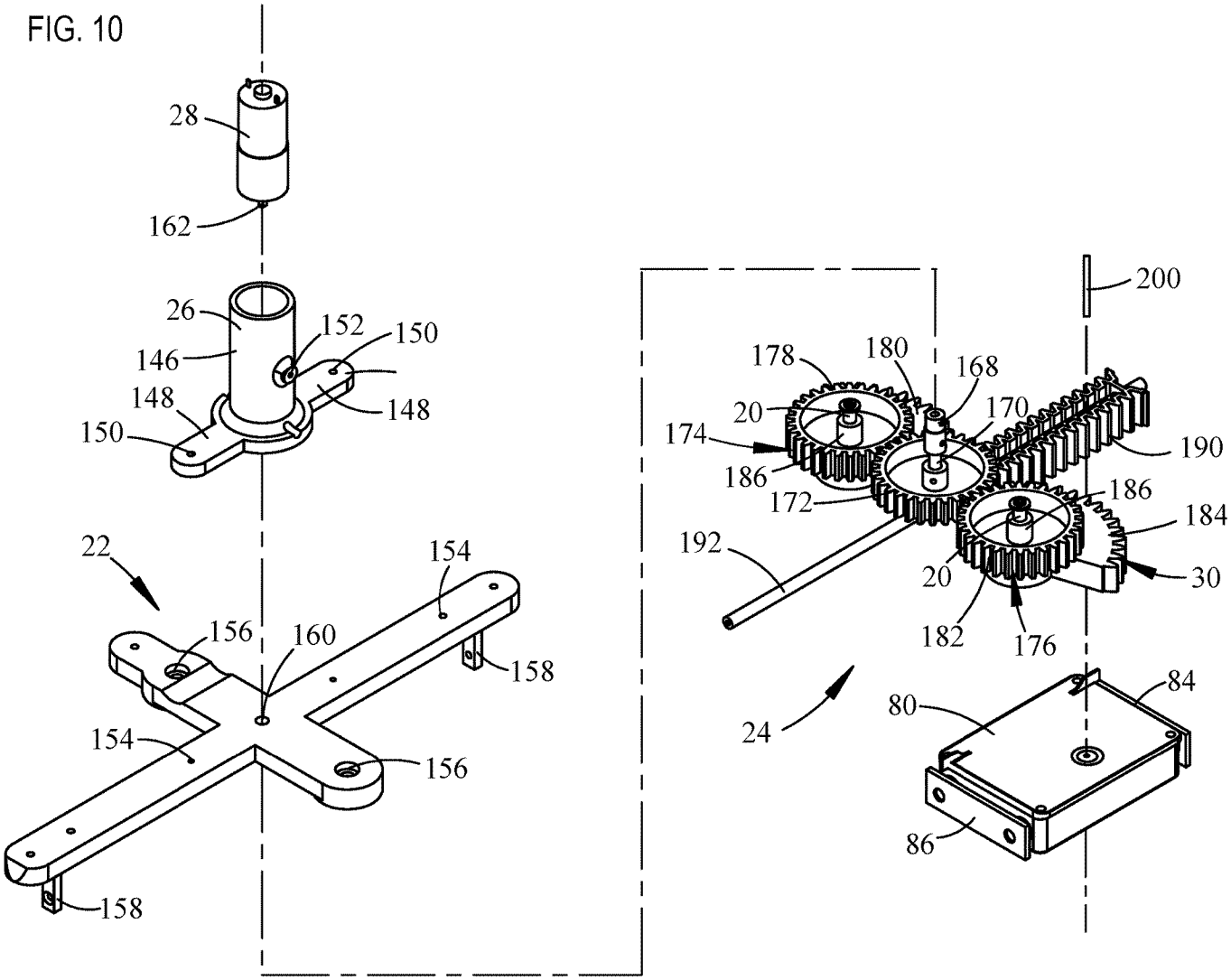

FIG. 10 is an exploded perspective view of the mangle drive assembly 24 which includes the mangle gear train 30, the bracket 22, the motor mount 26, and the drive motor 28, and which is connected to the striker carriage 80. The motor mount 26 preferably has a mounting tube 146 and oppositely extending flanges 148 with mounting holes 150 for receiving threaded fasteners which secure to mounting holes 154 in the bracket 22. A lock screw 152 is provided in the side of the mounting tube 146 for engaging the motor 28 to lock the motor 28 in a fixed position within the mounting tube 146, preventing rotation. The mounting tube 146 is aligned with the bracket 22 and the mangle drive assembly 24 such that a motor drive shaft 162 fits through the drive shaft aperture 160 and engages within a locking collet 168 atop a drive shaft 170 about which the drive gear 172 is rotatably mounted. Mounting apertures 156 are also provided spaced apart on different flanges of the mounting bracket 22 for receiving upper ends of spindles 20 about which the compound gears 174 and 176 are rotatably mounted. Additionally, mounting tabs 158 are provided for engaging with support posts 18 shown in FIG. 1. The mounting tabs have apertures for receiving threaded fasteners which secure to respective ones of the support posts 18.

The drive train 30 of the mangle drive assembly 24 has a central drive gear 172 which is disposed between and engaging the upper portions of two spaced apart, compound gears 174 and 176. The compound gears 174 and 176 are mounted on respective ones of the spindles 20. The compound gear 174 has an upper, first gear 178 which is mounted above in fixed relation to a first segmented gear 180. The compound gear 176 has an upper, second gear 182 which is mounted in fixed relation to a second segmented gear 184. Lock collets 186 are provided for securing the compound gears 174 and 176 to respective ones of the two spindles 20. The first segmented gear 180 and the segmented gear 184 engage on opposite sides of gear rack 190. Preferably, the drive gear 172, and the compound gear 174 and 176, and the rack 190 are spur gears. The rack 190 is slidably mounted to a guide rail 192. Pin 200 is provided for securing the rack 190 in fixed relation to the striker carriage 80, and is preferably threadably secured within the mounting port 82, such that the striker carriage 80 is disposed in fixed relation to the rack 190.

Figure 11:
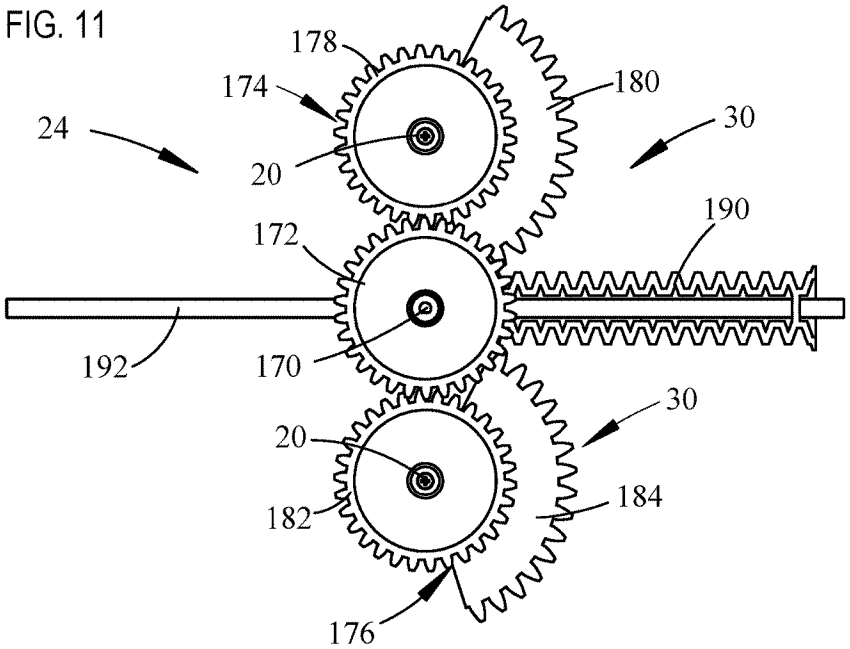
Figure 13:
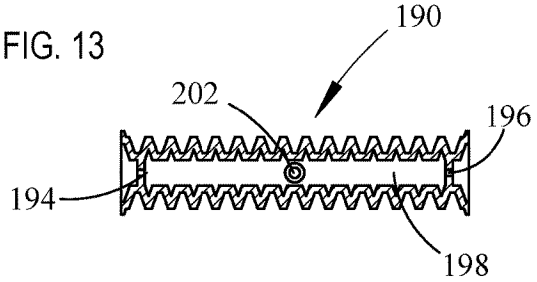
Figure 12:
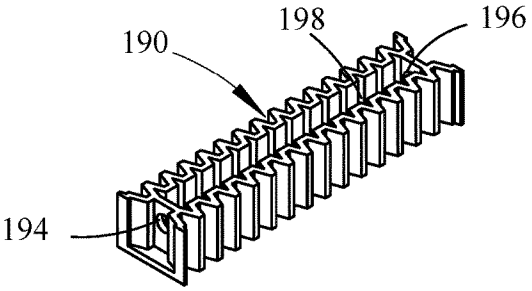

FIG. 11 is a top view of the mangle gear drive train 30. FIG. 12 is a perspective view of the rack 190, and FIG. 13 is a top view of the rack 190. The rack 190 has apertures 194 and 196 for slidably receiving the guide rail 192. The rack 190 preferably has a U-shaped longitudinal cross-section, with an enclosed lower end and an open upper end defining an open space 198, which also extends between the respective bosses through which the apertures 194 and 196 are formed. Preferably, an aperture 202 is provided on the lower end of the rack 190 for receiving a fastener which extends into the mounting port 82 in the striker carriage 80. The mangle gear drive train 30 operates in conventional fashion with rotation of the drive motor 28 in a single angular direction rotating the drive gear 172 in the same angular direction. The drive gear 172 engages the upper gears 178 and 182 to rotate the compound gears 174 and 176 in opposite angular directions, similarly rotating the segmented gears in respective opposite angular directions. The lower gears 180 and 184 of respective ones of the compound gears 174 and 176 will sequentially engage the rack 190, causing the rack to reciprocate and move the striker carriage 80 between the rearward position shown in FIG. 2 and the forward position disposed on an opposite end of the sound box 32. Reciprocation of the striker carriage 80 engages the strikers 84-88 against respective ones of the sound plates 70-76 to simulate the desired round chambering sound.

Figure 14:
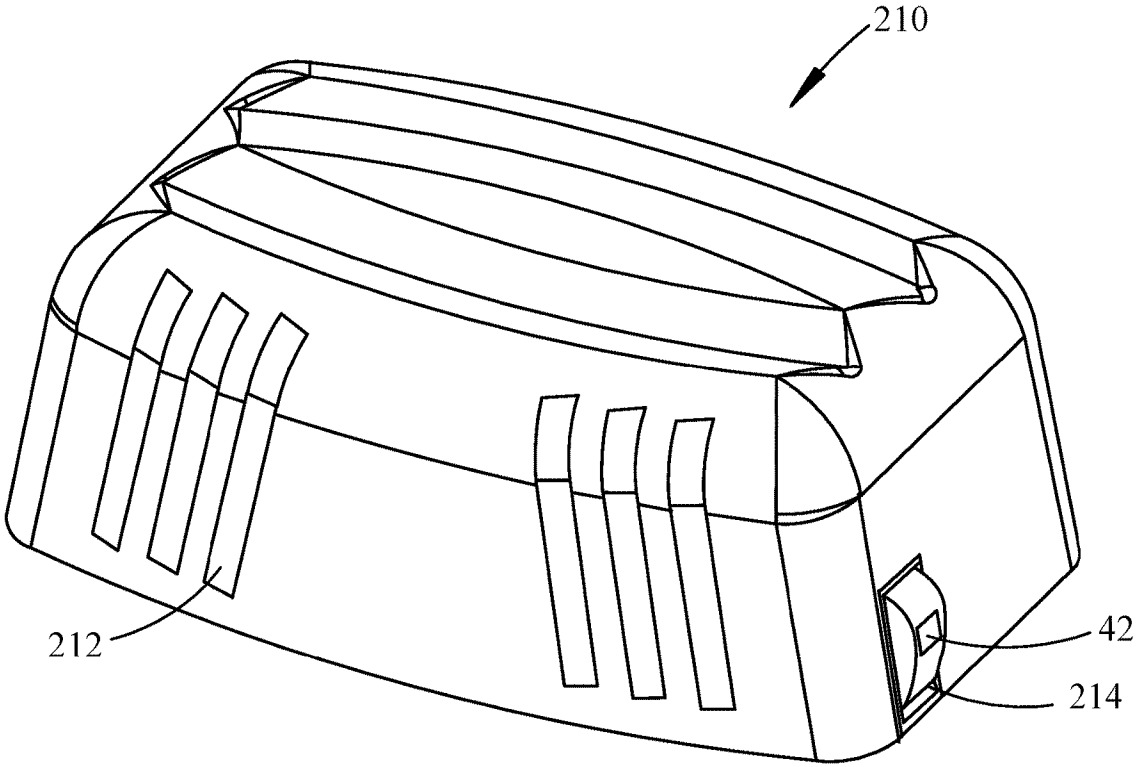

FIG. 14 is a perspective view of a cover 210 for the anti-intrusion device 12. Cover 210 has a lower end which fits adjacent the periphery of the base plate 16 shown in FIG. 1. Indentations 212 are provided along the sides and the top of the cover 210. The cover 210 preferably has an open bottom and enclosed top. Sound ports may be provided in respective portions of the cover 210. Control switch 42 is mounted within an aperture 214 in one side of the cover 210.

The present invention provides an anti-intrusion device which is automatically actuated when an intruder enters an enclosed space, or disturbs an actuation switch. The actuation of the device causes the drive motor 28 to rotate sufficiently to extend and move the striker carriage 80 from the rearward position to a forward position engaging the striker plate 86 against the forward sound plate 72. In moving to the forward position, the striker tab 90 will engage the recess 68 and make a lighter clacking sound. The drive motor 28 will continue rotating in the same angular direction, another compound gear will engage the back causing the striker carriage 80 to return to a rearward position, which along the way causes the striker tab 88 to engage the first sound plate 74, and then the rearward striker plate 84 will be slammed into the rearward sound plate 70. This will cause a clack, click, clack and returning a second click and another clack simulating the chambering of a round within a pump shotgun.

The present invention provides a mechanical device in which mechanical metal parts engage one another to accurately simulate the sound of a round being chambered within a pump shotgun. Metal parts which strike other metal parts are disposed within the sound box. The frame enclosure of the sound box provides an echo chamber to enhance the sound of the metal parts engaging and being struck, to accurately reproduce the chambering sounds.

Although the preferred embodiment has been described in detail, it should be understood that various changes, substitutions and alterations can be made therein without departing from the spirit and scope of the invention as defined by the appended claims.

What is claimed is:

1. An anti-intrusion device for simulating sounds from a round being chambered in a pump shotgun, comprising:

a sound box having a frame enclosure;

a striker carriage movably disposed in said sound box for moving between a first position and a second position to engage metal striker plates and metal striker tabs against sound plates to simulate the sounds of a round being chambered;

a mangle drive assembly mounted atop the sound box for moving said striker carriage between said first position and said second position;

an electric drive motor powering said mangle drive assembly, wherein said drive motor which is actuated to rotate a controlled angular displacement and move said striker carriage from said first position to said second position, and then back into said first position;

an electronic control unit for controlling operation of the anti-intrusion device to move the striker carriage from said first position, to said second position, and then back to said first position; and a trigger mechanism for actuating the electronic control unit to move said striker carriage from said first position, to said second position, and back to said first position.

2. The anti-intrusion device according to claim 1, wherein said trigger mechanism comprises a light source which generates a light beam, reflected off a remote sensor for returning to a light sensor, and wherein said light beam is broker by an intruder in passing a selected entry point to trigger said electronic control unit.

3. The anti-intrusion device according to claim 1, wherein said mangle drive assembly includes a mangle drive train which comprises:

a drive gear connected directly to said drive motor for rotating there-with, said drive gear coupled to a first compound gear and a second compound gear for rotating to turn said first compound gear and said second compound gear; and said first and second compound gears connected directly to a gear rack, such that rotating of said drive gear in a first angular direction rotates said first compound gear and said second compound gears in opposite angular directions to one another, and said first and second compound gears engage said gear rack moving said gear rack first from said first position to said second position, and then sequentially from said second position to said first position.

4. The anti-intrusion device according to claim 1, wherein said drive motor is a stepper motor.

5. The anti-intrusion device according to claim 1, further comprising a mounting bracket comprising a yoke which is mounted to a plurality of mounting post and a plurality of spindles to which at least one of said gears are rotatably mounted.

6. The anti-intrusion device according to claim 5, wherein a motor mounting bracket is mounted to said mounting bracket, and said drive motor is mounted to said motor mounting bracket and directly connected to said drive gear of said mangle gear train.

7. The anti-intrusion device according to claim 1, wherein said striker carriage comprises a forward striker plate and a rearward striker plate, said forward striker plate mounted to a forward end of said striker carriage and aligned for striking a forward sound plate mounted to said sound box, and said rearward striker plate mounted to said striker carriage and aligned for striking a rearward sound plate which is mounted to said reward end of said sound box.

8. The anti-intrusion device according to claim 7, further comprising a first striker tab and a second striker tab, wherein said first and second striker tabs are mounted for moveably extending from a side of said striker carriage and engage respective one of said first and second striker tabs.

9. An anti-intrusion device for simulating sounds from a round being chambered in a pump shotgun, comprising:

a sound box having a frame enclosure;

a striker carriage movably disposed in said sound box for moving between a first position and a second position to engage metal striker plates and metal striker tabs against sound plates to simulate the sounds of a round being chambered;

wherein said striker carriage includes a forward striker plate and a rearward striker plate, said forward striker plate mounted to a forward end of said striker carriage and aligned for striking a forward sound plate mounted to said sound box, and said rearward striker plate mounted to said striker carriage and aligned for striking a rearward sound plate which is mounted to said reward end of said sound box;

a mangle drive assembly mounted atop the sound box for moving said striker carriage between said first position and said second position;

an electric drive motor powering said mangle drive assembly, wherein said drive motor which is actuated to rotate a controlled angular displacement and move said striker carriage from said first position to said second position, and then back into said first position;

an electronic control unit for controlling operation of the anti-intrusion device to move the striker carriage from said first position, to said second position, and then back to said first position; and a trigger mechanism for actuating the electronic control unit to move said striker carriage from said first position, to said second position, and back to said first position.

10. The anti-intrusion device according to claim 9, wherein said mangle drive assembly includes a mangle drive train which comprises:

a drive gear connected directly to said drive motor for rotating there-with, said drive gear coupled to a first compound gear and a second compound gear for rotating to turn said first compound gear and said second compound gear; and said first and second compound gears connected directly to a gear rack, such that rotating of said drive gear in a first angular direction rotates said first compound gear and said second compound gears in opposite angular directions to one another, and said first and second compound gears engage said gear rack moving said gear rack first from said first position to said second position, and then sequentially from said second position to said first position.

11. The anti-intrusion device according to claim 9, wherein said trigger mechanism comprises a light source which generates a light beam, reflected off a remote sensor for returning to a light sensor, and wherein said light beam is broker by an intruder in passing a selected entry point to trigger said electronic control unit.

12. The anti-intrusion device according to claim 9, wherein said mangle drive assembly includes a mangle drive train which comprises:

a drive gear connected directly to said drive motor for rotating there-with, said drive gear coupled to a first compound gear and a second compound gear for rotating to turn said first compound gear and said second compound gear; and said first and second compound gears connected directly to a gear rack, such that rotating of said drive gear in a first angular direction rotates said first compound gear and said second compound gears in opposite angular directions to one another, and said first and second compound gears engage said gear rack moving said gear rack first from said first position to said second position, and then sequentially from said second position to said first position.

13. The anti-intrusion device according to claim 9, further comprising a mounting bracket comprising a yoke which is mounted to a plurality of mounting post and a plurality of spindles to which at least one of said gears are rotatably mounted.

14. The anti-intrusion device according to claim 13, wherein a motor mounting bracket is mounted to said mounting bracket, and said drive motor is mounted to said motor mounting bracket and directly connected to said drive gear of said mangle gear train.

15. The anti-intrusion device according to claim 13, further comprising a first striker tab and a second striker tab, wherein said first and second striker tabs are mounted for moveably extending from a side of said striker carriage and engage respective one of said first and second striker tabs.

16. An anti-intrusion device for simulating sounds from a round being chambered in a pump shotgun, comprising:

a sound box having a frame enclosure;

a striker carriage movably disposed in said sound box for moving between a first position and a second position to engage metal striker plates and metal striker tabs against sound plates to simulate the sounds of a round being chambered;

wherein said striker carriage includes a forward striker plate and a rearward striker plate, said forward striker plate mounted to a forward end of said striker carriage and aligned for striking a forward sound plate mounted to said sound box, and said rearward striker plate mounted to said striker carriage and aligned for striking a rearward sound plate which is mounted to said reward end of said sound box;

a first striker tab and a second striker tab, wherein said first and second striker tabs are mounted for moveably extending from a side of said striker carriage and engage respective one of said first and second striker tabs;

a mangle drive assembly mounted atop the sound box for moving said striker carriage between said first position and said second position;

an electric drive motor powering said mangle drive assembly, wherein said drive motor which is actuated to rotate a controlled angular displacement and move said striker carriage from said first position to said second position, and then back into said first position;

an electronic control unit for controlling operation of the anti-intrusion device to move the striker carriage from said first position, to said second position, and then back to said first position; and a trigger mechanism for actuating the electronic control unit to move said striker carriage from said first position, to said second position, and back to said first position.

17. The anti-intrusion device according to claim 16, wherein said mangle drive assembly includes a mangle drive train which comprises:

a drive gear connected directly to said drive motor for rotating there-with, said drive gear coupled to a first compound gear and a second compound gear for rotating to turn said first compound gear and said second compound gear; and said first and second compound gears connected directly to a gear rack, such that rotating of said drive gear in a first angular direction rotates said first compound gear and said second compound gears in opposite angular directions to one another, and said first and second compound gears engage said gear rack moving said gear rack first from said first position to said second position, and then sequentially from said second position to said first position.

18. The anti-intrusion device according to claim 17, wherein said trigger mechanism comprises a light source which generates a light beam, reflected off a remote sensor for returning to a light sensor, and wherein said light beam is broker by an intruder in passing a selected entry point to trigger said electronic control unit.

19. The anti-intrusion device according to claim 16, wherein said mangle drive assembly includes a mangle drive train which comprises:

a drive gear connected directly to said drive motor for rotating there-with, said drive gear coupled to a first compound gear and a second compound gear for rotating to turn said first compound gear and said second compound gear; and said first and second compound gears connected directly to a gear rack, such that rotating of said drive gear in a first angular direction rotates said first compound gear and said second compound gears in opposite angular directions to one another, and said first and second compound gears engage said gear rack moving said gear rack first from said first position to said second position, and then sequentially from said second position to said first position.

20. The anti-intrusion device according to claim 16, further comprising a mounting bracket comprising a yoke which is mounted to a plurality of mounting post and a plurality of spindles to which at least one of said gears are rotatably mounted; and a motor mounting bracket is mounted to said mounting bracket, and said drive motor is mounted to said motor mounting bracket and directly connected to said drive gear of said mangle gear train.

* * * * *